US009913040B2

(12) United States Patent
Zhao et al.

(10) Patent No.: US 9,913,040 B2
(45) Date of Patent: Mar. 6, 2018

(54) CAPACITIVE SILICON MICROPHONE AND FABRICATION METHOD THEREOF

(71) Applicant: SHANGHAI IC R&D CENTER CO., LTD., Shanghai (CN)

(72) Inventors: Yuhang Zhao, Shanghai (CN); Yong Wang, Shanghai (CN); Xiaoxu Kang, Shanghai (CN); Yan Chen, Shanghai (CN)

(73) Assignee: SHANGHAI IC R&D CENTER CO., LTD, Shanghai (CN)

( * ) Notice: Subject to any disclaimer, the term of this patent is extended or adjusted under 35 U.S.C. 154(b) by 0 days.

(21) Appl. No.: 15/033,113

(22) PCT Filed: Sep. 26, 2014

(86) PCT No.: PCT/CN2014/087491
§ 371 (c)(1),
(2) Date: Apr. 29, 2016

(87) PCT Pub. No.: WO2015/078227
PCT Pub. Date: Jun. 4, 2015

(65) Prior Publication Data

US 2016/0286317 A1 Sep. 29, 2016

(30) Foreign Application Priority Data

Nov. 29, 2013 (CN) ..... 2013 1 0631540

(51) Int. Cl.

| | |
|---|---|
| ***H04R 7/20*** | (2006.01) |
| ***H04R 19/00*** | (2006.01) |
| ***H04R 19/04*** | (2006.01) |
| ***H04R 7/08*** | (2006.01) |
| ***H04R 31/00*** | (2006.01) |

(52) U.S. Cl.
CPC ..... *H04R 7/20* (2013.01); *H04R 7/08* (2013.01); *H04R 19/005* (2013.01); *H04R 19/04* (2013.01); *H04R 31/00* (2013.01); *H04R 31/003* (2013.01); *H04R 31/006* (2013.01); *H04R 2201/003* (2013.01); *H04R 2231/003* (2013.01); *H04R 2410/03* (2013.01)

(58) Field of Classification Search
CPC ..... H04R 19/04; H04R 19/005; H04R 2201/003; H04R 7/20
See application file for complete search history.

(56) References Cited

U.S. PATENT DOCUMENTS

2007/0201710 A1* 8/2007 Suzuki ..... B81B 3/0072 381/174
2010/0278372 A1* 11/2010 Zhang ..... H04R 1/222 381/412

* cited by examiner

*Primary Examiner* — Matthew Eason
(74) *Attorney, Agent, or Firm* — Tianchen LLC.

(57) ABSTRACT

A capacitive silicon microphone comprises: a first dielectric layer sets on a substrate with a back cavity, a lower polar plate which is located over the back cavity, a first elastic member of which an inner edge is connected with the edge of the lower polar plate and an outer edge is located on the upper surface of the first dielectric layer, a second dielectric layer which is located on the outer edge of the first elastic member and right above the first dielectric layer, an upper polar plate which has a plurality of release holes and is formed above the lower polar plate with an air gap in between, a second elastic member of which an inner edge is connected with the edge of the upper polar plate and an outer edge is located on the upper surface of the second dielectric layer.

11 Claims, 9 Drawing Sheets

--Prior Art--

CAPACITIVE SILICON MICROPHONE AND FABRICATION METHOD THEREOF

CROSS-REFERENCE TO RELATED APPLICATION

The application claims the priority benefit of International Patent Application Serial No. PCT/CN2014/087491, filed Sep. 26, 2014, which is related to and claims the priority benefit of China patent application serial No. 201310631540.5 filed Nov. 29, 2013. The entirety of each of the above-mentioned patent applications is hereby incorporated by reference herein and made a part of the specification.

FIELD OF THE INVENTION

The present invention relates generally to the semiconductor manufacturing technology, particularly to a capacitive silicon microphone and fabrication method thereof.

BACKGROUND OF THE INVENTION

With the rapid development of mobile communication technologies, the uses of communication devices such as smartphones, laptops and tablet computers by consumers are increasing; moreover, those electronic devices are becoming more functional while the size of which keeps getting smaller. Along the decrease of volume of electronic devices, the size of electronic components in which are also decreases. However, the requirements for the devices performance and consistency are increased. At present, a capacitive silicon microphone is a microphone fabricated by a surface (e.g. silicon substrate) processing technology or a bulk silicon processing technology. The surface processing technology or the bulk silicon processing technology is compatible with integrated circuit fabrication process. Moreover, the size of the microphones may become very small by using a miniaturizing CMOS process technology, thus being widely applied into portable electronic products such as mobile phones, laptops, Bluetooth headsets, and cameras.

Refer to FIG. 1, a MEMS microphone includes a silicon substrate 10, an back cavity 101 which is up-down through-cut of the substrate 10, a parallel plate capacitor which is set on the substrate 10 and is constituted of an upper polar plate 103 and a lower polar plate 102. The lower polar plate 102 is usually a fixed polar plate, the upper polar plate 103 is a vibrating diaphragm of the microphone, and there is an air gap 104 formed between the lower polar plate 102 and the upper polar plate 103 as an insulating dielectric of the parallel plate capacitor. A supporting body 105 is set on the periphery of the upper polar plate 103 supporting the upper polar plate 103, and a plurality of release holes 106 are set on the upper surface of the upper polar plate 103 to volatilize dielectric material filled in the air gap 104 during the fabrication process. The upper polar plate 103 of the parallel plate capacitor vibrates due to external outside acoustic signal, which causes changes in the distance between the upper polar plate 103 and the lower polar plate 102, thus to change the capacitance of the parallel plate capacitor, generates a voltage signal and so as to realize the acoustic-electric conversion function.

In practical production, polycrystalline silicon films are usually adopted as the upper polar plate and the lower polar plate of the MEMS microphones. The polycrystalline silicon films are generally grown by Low Pressure Chemical Vapor Deposition (LPCVD) process. There is an internal stress gradient difference problem between different areas of the polycrystalline silicon film. Moreover, there is a distinct difference in internal stress of vibrating diaphragm of silicon microphone chips in different production batches, which can influence the consistency of process performance and product quality. On the other hand, if the stress of the polycrystalline silicon film is released insufficiently, it will cause an over large background noise, and if the range of mechanical vibration of the vibrating diaphragm is small, it will cause low sensitivity of the MEMS microphone.

Therefore, in the IC industry, it is desired to obtain a novel capacitive silicon microphone structure and a fabrication method thereof, which would release the stress effectively, enhance the structure sensitivity and overcome non-uniformity problem of the stresses.

BRIEF SUMMARY OF THE DISCLOSURE

In order to overcome the above problems, the present invention provides a capacitive silicon microphone, which can release the structural stress of the film effectively and overcome the non-uniformity of the stresses.

In order to achieve the purpose above, the present invention provides a capacitive silicon microphone, comprising:

- a substrate with a back cavity;
- a first dielectric layer, which is formed over the substrate;
- a lower polar plate, which is located over the back cavity, as a vibrating diaphragm of the capacitive silicon microphone;
- a first elastic member, which has an inner edge and an outer edge, the inner edge thereof being connected with edge of the lower polar plate, and the outer edge thereof being located on the upper surface of the first dielectric layer;
- a second dielectric layer, which is located on the outer edge of the first elastic member and right above the first dielectric layer;
- an upper polar plate as a back electrode of the capacitive silicon microphone, which has a plurality of release holes and is formed above the lower polar plate with an air gap in between;
- a second elastic member, which has an inner edge and an outer edge, the inner edge thereof being connected with edge of the upper polar plate, and the outer edge thereof being located on the upper surface of the second dielectric layer.

Preferably, inner sidewall of the first dielectric layer has a first etch-stop layer, and/or inner sidewall of the second dielectric layer has a second etch-stop layer.

Preferably, the first elastic member has at least two first elastic elements that uniformly distribute at the periphery of the lower polar plate, and the second elastic member has at least two second elastic elements that uniformly distribute at the periphery of the upper polar plate. Each of the first elastic elements has an inner edge connected with the edge of the lower polar plate and an outer edge located on the upper surface of the first dielectric layer. Each of the second elastic elements has an inner edge connected with the edge of the upper polar plate and an outer edge located on the upper surface of the second dielectric layer.

Preferably, the vertical section of the first elastic member and/or the second elastic member is concave-convex shape, and the horizontal section of the first elastic member and/or the second elastic member is concave-convex shape.

Preferably, the first elastic member has a first elastic coefficient, and the second elastic member has a second elastic coefficient, the second elastic coefficient is higher than the first elastic coefficient.

Preferably, the first elastic member and the second elastic member are regarded as a spring, and the surface stress of the upper polar plate and the lower polar plate may be calculated from the following formula:

$$TS=(\text{Asp}/\text{Asp-covered})\cdot(K1/\text{Ssp})\cdot(\text{Wsp}/K2)\cdot(\text{Thsp}/Th0)\cdot T0$$

Wherein, TS indicates the surface stress of the lower polar plate when the first elastic member is set or the surface stress of the upper polar plate when the second elastic member is set. Asp indicates effective area of the corresponding spring. Asp-covered indicates region area of the corresponding spring. Ssp indicates the number of the coils of the corresponding spring. Wsp indicates the diameter of the corresponding spring, Thsp indicates the length of the corresponding spring, Th0 indicates the thickness of the air gap, T0 indicates the surface stress of the lower polar plate when the first elastic member is not set or the surface stress of the upper polar plate when the second elastic member is not set, K1 indicates the elastic coefficient of the corresponding spring in single turn, and K2 indicates the elastic coefficient of the corresponding spring in unit width.

Preferably, the structure of the upper polar plate or the lower polar plate is a polycrystalline silicon film.

The present invention further provides a fabrication method of a capacitive silicon microphone, comprising the following steps:

Step a). growing a first dielectric layer and a lower polar plate sequentially on the substrate;

Step b). forming several first grooves in the first dielectric layer which is located around the lower polar plate;

Step c). forming a first elastic member in the first grooves, on the surface of the first dielectric layer and on the upper surface of edge of the lower polar plate;

Step d). forming a second dielectric layer on the upper surface of the lower polar plate and the first elastic member;

Step e). forming an upper polar plate on the upper surface of the second dielectric layer above the lower polar plate;

Step f). forming several second grooves in the second dielectric layer which is located around the upper polar plate;

Step g). forming a second elastic member in the second grooves, on the surface of the second dielectric layer and on the upper surface of edge of the upper polar plate;

Step h). forming release holes on the upper polar plate;

Step i). forming a back cavity in the substrate which is located below the lower polar plate;

Step j). removing the first dielectric layer which is located below the lower polar plate through the back cavity to form a first air gap; removing the second dielectric layer which is located below the upper polar plate through the release holes to form a second air gap;

Wherein, the lower polar plate is used as a vibrating diaphragm of the silicon microphone and the upper polar plate is used as a back electrode of the silicon microphone.

Preferably, between the step a) and the step b), further comprises: firstly, forming a ring-shaped groove in edge region of the first dielectric layer; then depositing a first etch-stop layer in the ring-shaped groove;

the step b) further comprising: forming the several first grooves in the first dielectric layer which are located between the first etch-stop layer and the lower polar plate;

between the step d) and the step e), further comprises: firstly, forming a ring-shaped groove in edge region of the second dielectric layer; then depositing and forming a second etch-stop layer in the ring-shaped groove;

the step f) further comprising: forming the several second grooves in the second dielectric layer which is located between the second etch-stop layer and the upper polar plate;

the step j) further comprises: removing the first dielectric layer located below the lower polar plate through the back cavity, and stopping at the first etch-stop layer to form the first air gap; removing the second dielectric layer located below the upper polar plate through the release holes and stopping at the second etch-stop layer to form the second air gap.

According to the capacitive silicon microphone and the fabrication method thereof provided in the present invention, by setting the first dielectric layer on the substrate with the back cavity, setting the lower polar plate over the back cavity, setting the inner edge of the first elastic member to be connected with the edge of the lower polar plate and the outer edge of the first elastic member to be located on the upper surface of the first dielectric layer, setting the second dielectric layer to be located on the outer edge of the first elastic member and right above the first dielectric layer, setting the upper polar plate which has a plurality of release holes and is formed above the lower polar plate with an air gap in between, and setting the inner edge of the second elastic member to be connected with the edge of the upper polar plate and the outer edge of the second elastic member to be located on the upper surface of the second dielectric layer. Wherein the first elastic member enhances the sensitivity of the lower polar plate to sound pressure meanwhile reduces the structural stress of the polycrystalline silicon film. The second elastic member as the back electrode of the silicon microphone of the present invention will effectively release the structural stress caused by the polycrystalline silicon film and the dielectric layer, which enhance the flatness of the polycrystalline silicon film and reduce the overall noise of the MEMS microphone.

DETAILED DESCRIPTION OF THE EMBODIMENTS

In order to make the contents of the present invention clear and easy to be understand, the contents of the present inventions is described in detail below in combination with the drawings of the Description. Certainly, the present invention is not limited to such specific embodiments, and the general substitute well known by persons skilled in the art is encompassed in the protection scopes of the present invention.

In the capacitive silicon microphone provided in the present invention, a first dielectric layer is set on a substrate with a back cavity, a lower polar plate is set over the back cavity, a first elastic member of which its inner edge is connected with the edge of the lower polar plate and its outer edge is located on the upper surface of the first dielectric layer, a second dielectric layer which is located on the outer edge of the first elastic member and right above the first dielectric layer, a upper polar plate which has a plurality of release holes and is formed over the lower polar plate with an air gap in between, and a second elastic member of which its inner edge is connected with the edge of the upper polar plate and its outer edge is located on the upper surface of the second dielectric layer.

Figure 1:
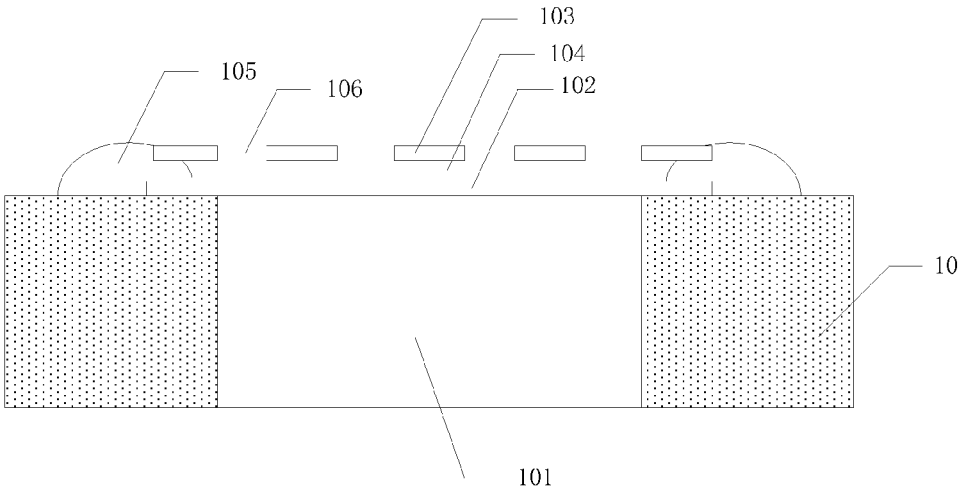
FIG. 1 shows a structural schematic diagram of a capacitive silicon microphone according to the prior art.
Figure 2:
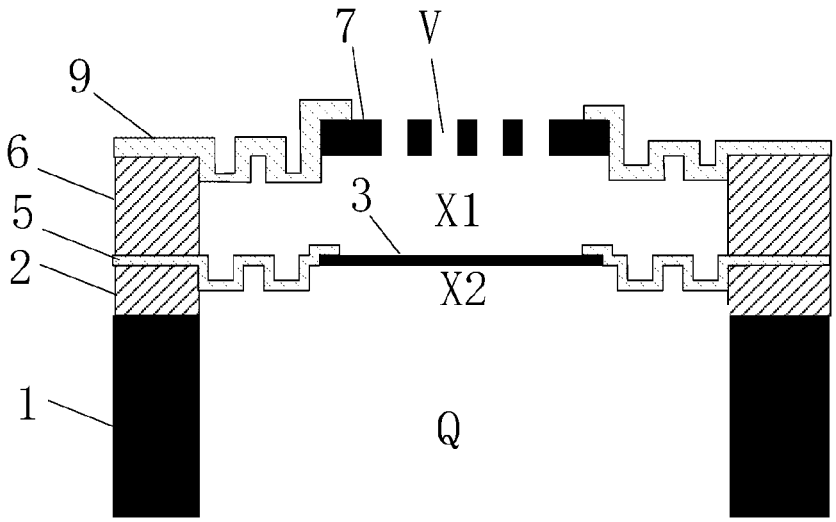
FIG. 2 shows a structural schematic diagram of a capacitive silicon microphone according to one preferred embodiment of the present invention.
Figure 3:
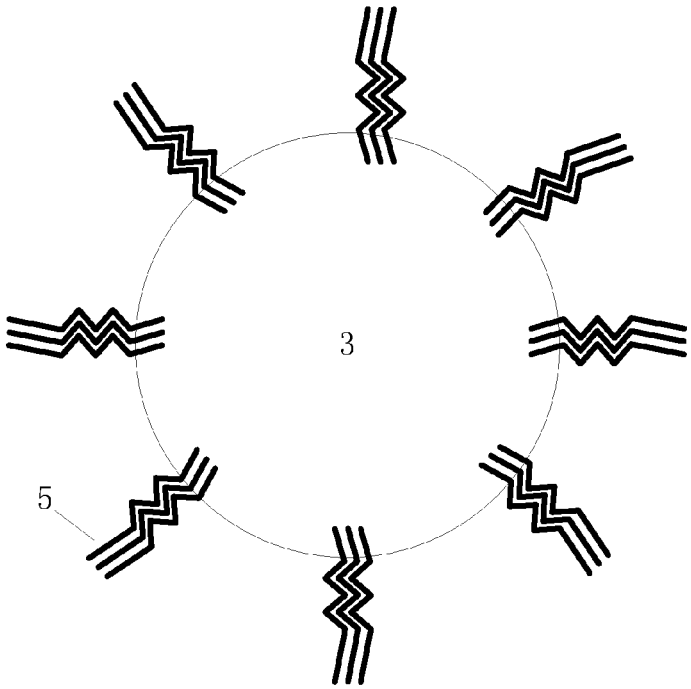
FIG. 3 is a top structural schematic diagram of a first elastic member of a capacitive silicon microphone according to one preferred embodiment of the present invention.
Figure 4:
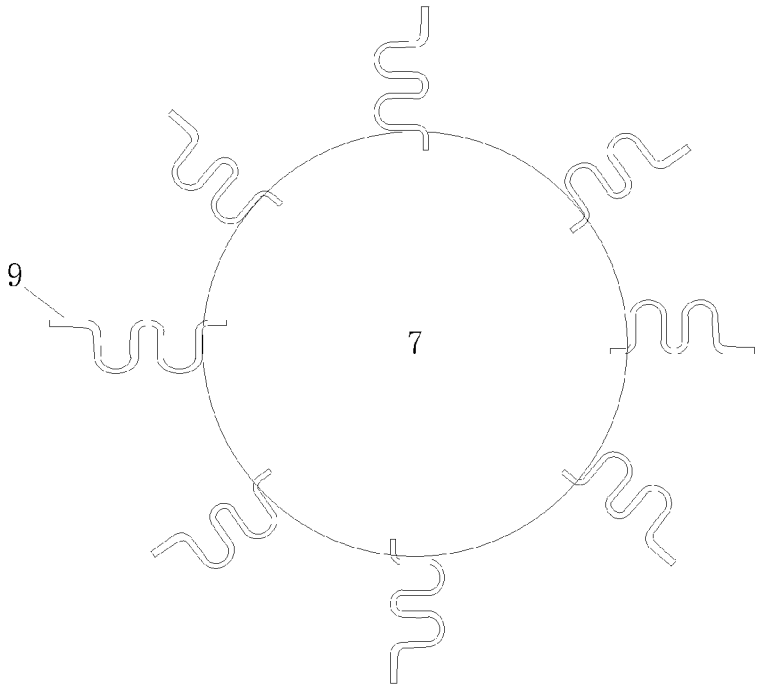
FIG. 4 is a top structural schematic diagram of a second elastic member of a capacitive silicon microphone according to one preferred embodiment of the present invention.
Figure 5:
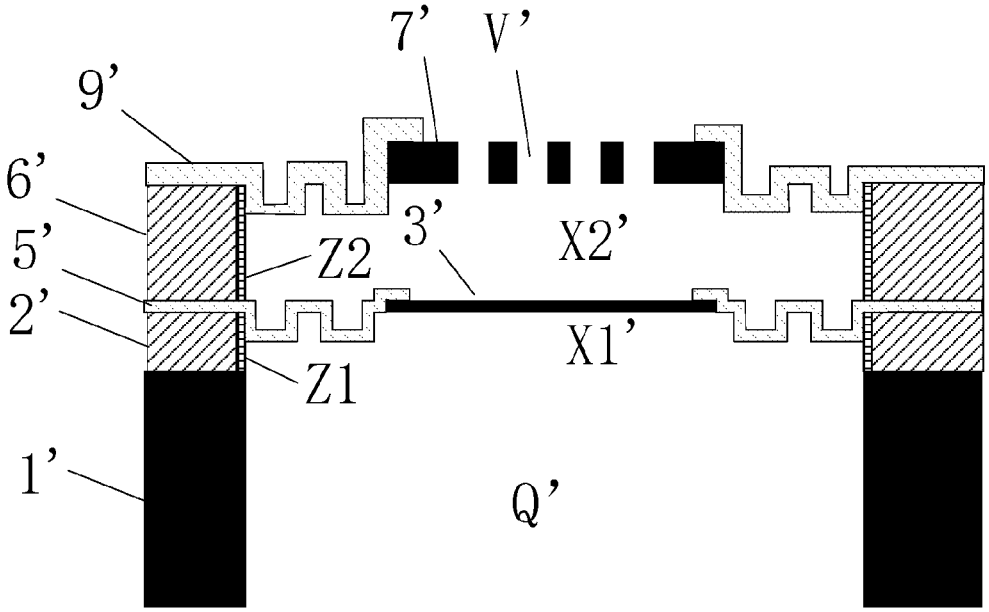
FIG. 5 shows a structural schematic diagram of a capacitive silicon microphone according to another preferred embodiment of the present invention.

Hereinafter, the structure of the capacitive silicon microphone will be described in detail by specific embodiments with reference to FIG. 2 to FIG. 5. Wherein, FIG. 2 shows a structural schematic diagram of a capacitive silicon microphone according to one preferred embodiment of present invention. FIG. 3 is a top structural schematic diagram of the first elastic member of the capacitive silicon microphone according to one preferred embodiment of present invention. FIG. 4 is a top structural schematic diagram of the second elastic member of the capacitive silicon microphone according to one preferred embodiment of present invention. FIG. 5 shows a structural schematic diagram of the capacitive silicon microphone according to another preferred embodiment of present invention. It should be noted that the very simple manner and the unprecise scale of drawings only intends to clearly and conveniently explain the present embodiment.

Refer to FIG. 2, in the present embodiment, a capacitive silicon microphone comprises:

a substrate 1 with a back cavity Q;

specifically, the substrate 1 may be any semiconductor substrates, for example a silicon substrate.

a first dielectric layer 2 which is formed over the substrate 1;

specifically, the material of the first dielectric layer 2 may be silicon dioxide, silicon nitride or the like; the first dielectric layer 2 is used to support a first elastic member 5 of a lower polar plate 3.

The lower polar plate 3 is located over the back cavity Q, and used as a vibrating diaphragm of the silicon microphone;

specifically, the structure of the lower polar plate 3 may be a polycrystalline silicon film.

The first elastic member 5 has an inner edge and an outer edge, the inner edge thereof being connected with the edge of the lower polar plate 3, and the outer edge thereof being located on the upper surface of the first dielectric layer 2;

specifically, the first elastic member 5 has eight first elastic elements that uniformly distribute at the periphery of the lower polar plate 3 as shown in FIG. 3; With reference to FIGS. 2 and 3, the vertical section of the first elastic element of the first elastic member 5 is concave-convex shape, and the horizontal section of the first elastic element of the first elastic member 5 is also concave-convex shape.

a second dielectric layer 6, which is located on the outer edge of the first elastic member 5 and right above the first dielectric layer 2;

specifically, the material of the second dielectric layer 6 may be silicon dioxide, silicon nitride or the like; the second dielectric layer 6 is used to support a second elastic member 9 of an upper polar plate 7.

The upper polar plate 7 as a back electrode of the silicon microphone, which has a plurality of release holes V and is formed above the lower polar plate 3 with an air gap X1 in between;

specifically, the structure of the upper polar plate 7 may be a polycrystalline silicon film.

The second elastic member 9 has an inner edge and an outer edge, the inner edge thereof being connected with the edge of the upper polar plate 7, and the outer edge thereof being located on the upper surface of the second dielectric layer 6.

Specifically, the second elastic member 9 has eight second elastic elements that uniformly distribute at the periphery of the upper polar plate 7 as shown in FIG. 4; With reference to FIGS. 2 and 4, the vertical section of the second elastic element of the second elastic member 9 is concave-convex shape, and the horizontal section of the second elastic element of the second elastic member 9 is also concave-convex shape.

In the present embodiment, the first elastic member 5 has a first elastic coefficient, the second elastic member 9 has a second elastic coefficient, and the second elastic coefficient is higher than the first elastic coefficient; for example, the magnitude of the second elastic coefficient is at least ten times the magnitude of the first elastic coefficient. Thus, it can prevent the overall noise of the microphone from being increased, due to the over deformation of the upper polar plate which is caused by the over deformation of the second elastic member; since deformation amount of first elastic member is large, the structural stress of the lower polar plate could be released effectively, the sensitivity is enhanced to sound pressure and the mechanical noise of the film layer is reduced.

The first elastic member 5 and the second elastic member 9 both are regarded as a spring, and the surface stress of the upper polar plate 7 and the lower polar plate 3 may be calculated from the following formula:

$$TS=(\mathrm{Asp}/\mathrm{Asp-covered})\cdot(K1/\mathrm{Ssp})\cdot(\mathrm{Wsp}/K2)\cdot(\mathrm{Thsp}/Th0)\cdot T0$$

Wherein TS indicates the surface stress of the lower polar plate when the first elastic member is set or the surface stress of the upper polar plate when the second elastic member is set, Asp indicates effective area of the corresponding spring, Asp-covered indicates region area of the corresponding spring, Ssp indicates the number of the coils of the corresponding spring, Wsp indicates the diameter of the corresponding spring, Thsp indicates the length of the corresponding spring, Th0 indicates the thickness of the air gap, T0 indicates the surface stress of the lower polar plate when the first elastic member is not set or the surface stress of the upper polar plate when the second elastic member is not set, K1 indicates the elastic coefficient of the corresponding spring in single turn, and K2 indicates the elastic coefficient of the corresponding spring in unit width.

Thus, the first elastic member 5 will contribute to release the structural stress of the lower polar plate 3 used as a vibrating diaphragm of the silicon microphone of the present invention, enhance the sensitivity of the lower polar plate 3 to sound pressure, meanwhile reduce the structural stress and the mechanical noise of the lower polar plate 3. The second elastic member 9 is used as the back electrode of the silicon microphone of the present invention, which will effectively release the structural stress caused by the upper polar plate 7 and the second dielectric layer 6, enhance the flatness of the upper polar plate 7 and reduce the overall noise of the MEMS microphone.

In another embodiment of the present invention, as shown in FIG. 5, inner sidewall of the first dielectric layer 2 has a first etch-stop layer Z1, and/or inner sidewall of the second dielectric layer 6 has a second etch-stop layer Z2. The first etch-stop layer Z1 and the second etch-stop layer Z2 is used as an stop position for etching when the first air gap X1 and the second air gap X2 of the silicon microphone are being formed, so as to form the first air gap X1 and the second air gap X2 according to a preset size to prevent over-etching.

Figure 6:
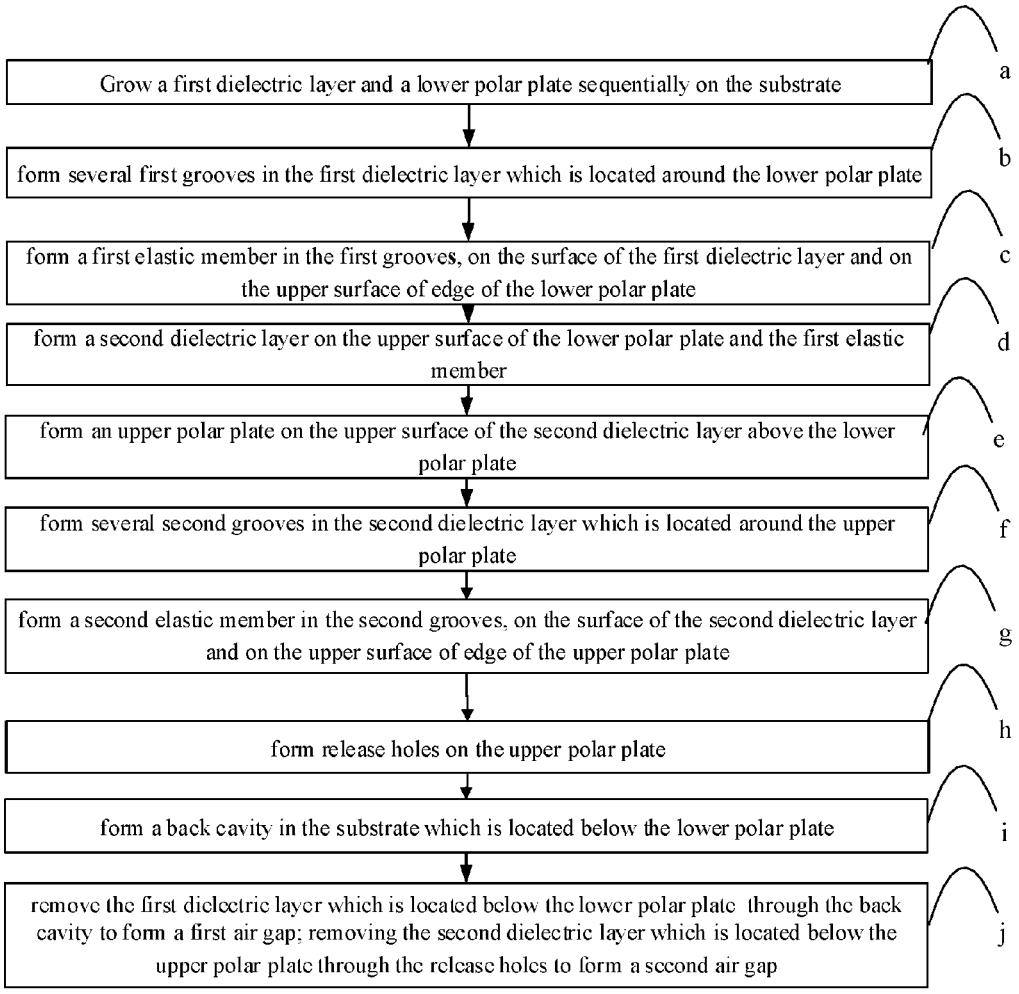
FIG. 6 shows a schematic diagram of a flow of a fabrication method of a capacitive silicon microphone according to one preferred embodiment of the present invention.
Figure 7A:
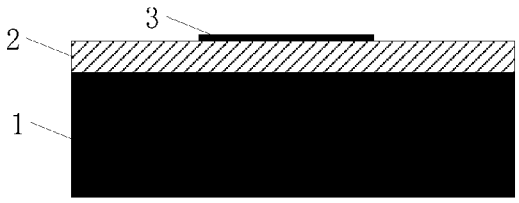
FIGS. 7A-7J show a schematic diagram corresponding to each fabrication step of a fabrication method of a capacitive silicon microphone according to one preferred embodiment of the present invention.

Hereinafter, the structure of the capacitive silicon microphone is further described in detail with reference to FIGS. 6 to 8 and specific embodiment. Wherein, FIG. 6 shows a schematic diagram of a flow of a fabrication method of a capacitive silicon microphone according to one preferred embodiment of the present invention; FIGS. 7A-7J show a schematic diagram corresponding to each fabrication step of a fabrication method of a capacitive silicon microphone according to one preferred embodiment of the present invention;

As shown in FIG. 6, a fabrication method of a capacitive silicon microphone according to one preferred embodiment of the present invention comprises the following steps:

Step a). growing the first dielectric layer 2 and the lower polar plate 3 sequentially on the substrate 1 as shown in FIG. 7A.

Specifically, the substrate 1 may be a silicon substrate; the method of growing the first dielectric layer 2 may be but not limited to a vapor deposition method; the method of growing the lower polar plate 3 may be but not limited to a vapor deposition method; since the lower polar plate 3 is used as a vibrating diaphragm of the microphone, it is usually a thin film, and may be any existing material which can be used as a vibrating diaphragm, herein it may be a polycrystalline silicon film.

Figure 7B:
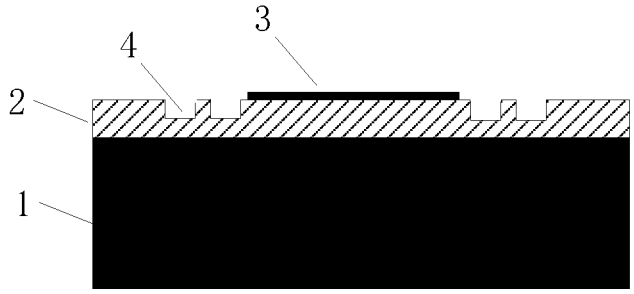

Step b). forming several first grooves 4 in the first dielectric layer 2 which is located around the lower polar plate 3 as shown in FIG. 7B.

Specifically, the method of forming the first groove 4 may be but not limited to a dry etching; the specific process parameters may be set according to the actual requirements. The first grooves 4 may be plural, and the number of the first grooves 4 is two in the present embodiment.

Figure 7C:
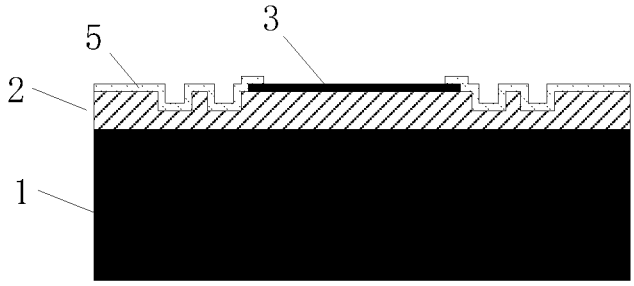

Step c). forming the first elastic member 5 in the first grooves, on the surface of the first dielectric layer 2 and on the upper surface of edge of the lower polar plate 3; the structure after completing the present step c) is shown in FIG. 7C.

Specifically, firstly forming the first elastic member 5 on the surface of the substrate 1 formed in step b); then etching away the first elastic member 5, which is located on the surface other than edge regions of the lower polar plate 3 by an etching process. Thus, the most of the upper surface of the lower polar plate 3 is exposed, but the edges of the lower polar plate 3 are connected with the first elastic member 5.

The first elastic member 5 will release the structural stress of the lower polar plate 3, enhance the sensitivity of the lower polar plate 3 to sound pressure, meanwhile reduce the mechanical noise of the lower polar plate 3.

It shall be noted that the inner side edge of the first elastic member 5 partially overlaps with the edge of the lower polar plate 3, in order to ensure that the formed first elastic member 5 is connected with the lower polar plate 3.

Figure 7D:
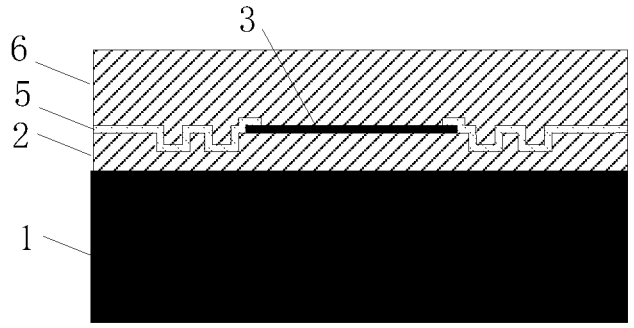

Step d). forming the second dielectric layer 6 on the upper surface of the lower polar plate 3 and the first elastic member 5 as shown in FIG. 7D.

Specifically, the method of forming the second dielectric layer 6 may be but not limited to a chemical vapor deposition method; material used for first dielectric layer 2 or the second dielectric layer 6 shall be material which is easily decomposable and volatile at certain conditions, for example, easily decomposable and volatile when being heated or easily decomposable and volatile when adding some chemical liquid.

Figure 7E:
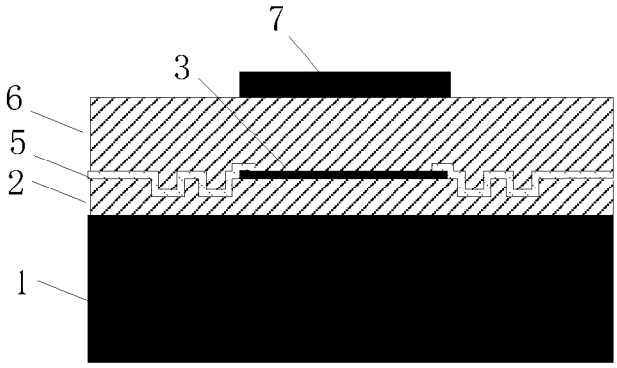

Step e). forming the upper polar plate 7 on the upper surface of the second dielectric layer 6 above the lower polar plate 3 as shown in FIG. 7E.

Figure 7F:
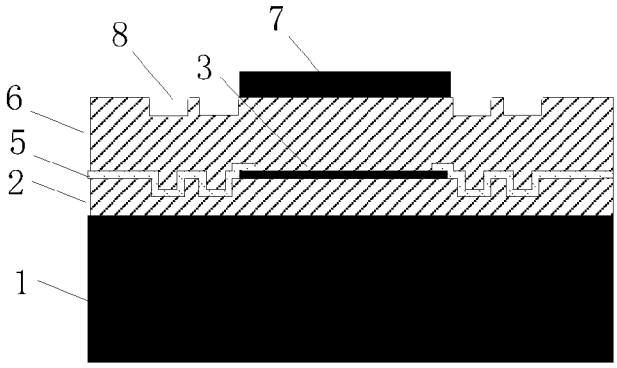

Specifically, the method of forming the upper polar plate 7 may be but not limited to a vapor deposition method, and the upper polar plate 7 may be polycrystalline silicon film;

Step f). forming several second grooves 8 in the second dielectric layer 6 which is located around the upper polar plate 7 as shown in FIG. 7F.

Specifically, the method of forming the second groove 8 may be but not limited to a dry etching; the specific process parameters may be set according to the actual requirements. The second grooves 8 may be plural, and the number of the second grooves 8 is two in the present embodiment.

Figure 7G:
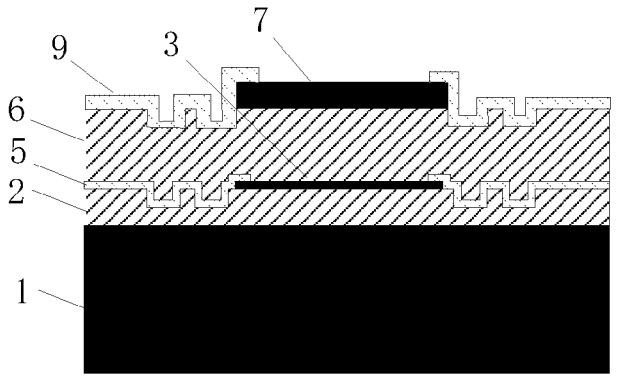

Step g). forming the second elastic member 9 in the second grooves 8, on the surface of the second dielectric layer 6 and on the upper surface of edge of the upper polar plate 7; the structure after completing the present step g) is shown in FIG. 7G.

Specifically, firstly forming the second elastic member 9 on the surface of the substrate 1 formed in step f); then etching away the second elastic member 9 which is located on the surface other than edge regions of the upper polar plate 7 by an etching process. Thus, the most of the upper surface of the upper polar plate 7 is exposed, but the edges of the upper polar plate 7 are connected with the second elastic member 9.

Thus, when the structural stress is produced on the upper polar plate 7, the structural stress may be released by the second elastic member 9, so as to enhance the flatness of the upper polar plate 7 and reduce the overall noise of the microphone.

It shall be noted that the inner side edge of the second elastic member 9 partially overlaps with the edge of the upper polar plate 7, in order to ensure the formed second elastic member 9 is connected with the edge of the upper polar plate 7.

Figure 7H:
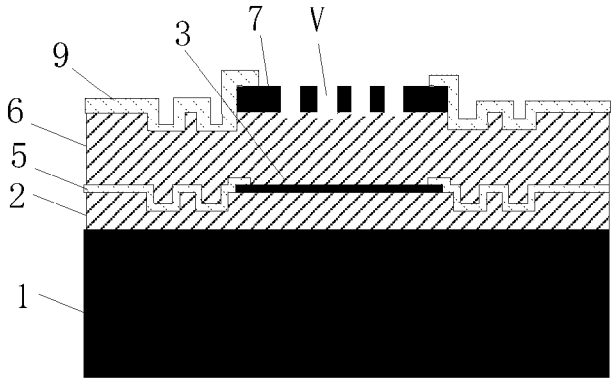

Step h). forming release holes V on the upper polar plate 7 as shown in FIG. 7H.

Specifically, the method of forming the release holes V may adopt the existing method, and for example, the release holes V may be formed by a lithography or an etching process, but the method is not limited to these, and the present invention does not make limitation on the method.

Figure 7I:
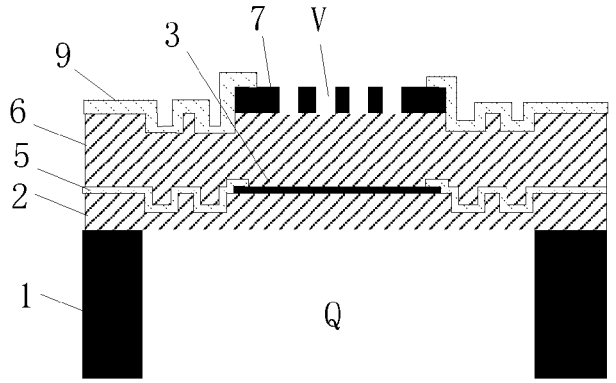

Step i). forming a back cavity Q in the substrate 1 which is located below the lower polar plate 3 as shown in FIG. 7I.

Specifically, the method of forming the back cavity Q may adopt the existing method, and it is not described in the present invention herein.

Figure 7J:
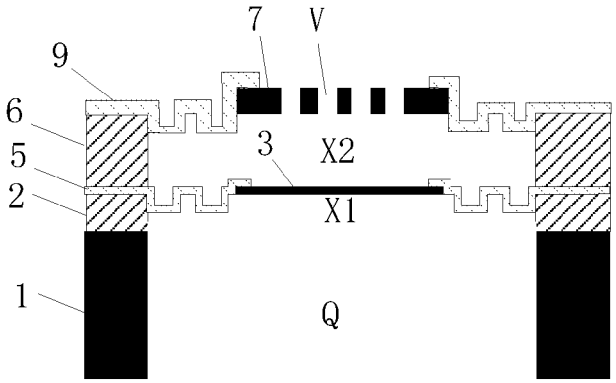

Step j). the first dielectric layer 2 located below the lower polar plate 3 is removed through the back cavity Q, in order to form the first air gap X1; and the second dielectric layer 6 located below the upper polar plate 7 is removed through the release holes V to form the second air gap X2 as shown in FIG. 7J.

Specifically, the first air gap X1 and the second air gap X2 may be formed simultaneously; for example, the whole substrate is put into the corrosive solution to remove portions of the first dielectric layer 2 and the second dielectric layer 6 by using wet etching; herein, since the corrosion of the corrosive solution starts from the portion of the first dielectric layer 2 which corresponds to the back cavity Q and gradually diffuses to the upper periphery the back cavity Q, it will take some time to corrode to the portion of the first dielectric layer 2 which is located at the upper periphery the back cavity Q; similarly, the corrosion of the corrosive solution starts from the portion of the second dielectric layer 6 corresponding to the release holes V and gradually diffuses to the lower periphery the release holes V, so that it will also take some time to corrode to the portion of the second dielectric layer 6 which is located at the lower periphery the release holes V; the position of corrosion of the first dielectric layer 2 and the second dielectric layer 6 may be controlled by controlling the process time, such that a certain thickness of the first dielectric layer 2 and the second dielectric layer 6 can be remained to respectively use as the supporting body of the first elastic member 5 and the second elastic member 9.

It shall be noted that the lower polar plate 3 is used as a vibrating diaphragm of the silicon microphone, and the upper polar plate 7 is used as a back electrode of the silicon microphone.

In another preferred embodiment of the present invention, the structure of the capacitive silicon microphone is shown in FIG. 5, and the fabrication method of the capacitive silicon microphone is different from that of the above embodiment in that.

Figure 8A:
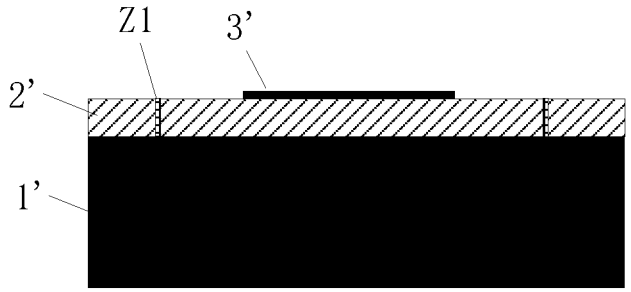
FIG. 8A shows a structural schematic diagram after forming a first etch-stop layer according to another preferred embodiment of the present invention.

In the embodiment, between the step a) and the step b), further comprises: firstly, forming a ring-shaped groove in edge region of the first dielectric layer 3', and then depositing a first etch-stop layer Z1 in the ring-shaped groove, as shown in FIG. 8A. FIG. 8A shows a structural schematic diagram after forming the first etch-stop layer according to another preferred embodiment of the present invention.

Figure 8B:
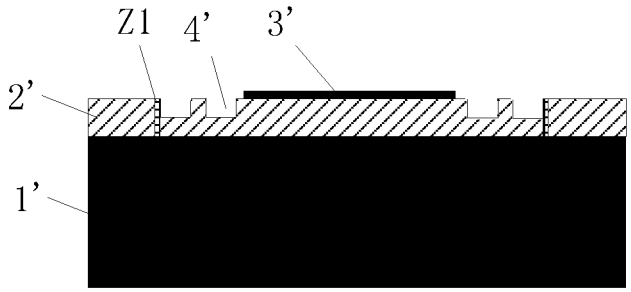
FIG. 8B shows a structural schematic diagram after forming first grooves according to another preferred embodiment of the present invention.

In the embodiment, the step b) specifically comprises: forming several first grooves 4' in the first dielectric layer 2' which are located between the first etch-stop layer Z1 and the lower polar plate 3'; as shown in FIG. 8B. FIG. 8B shows a structural schematic diagram after forming the first groove according to another preferred embodiment of the present invention.

Figure 8C:
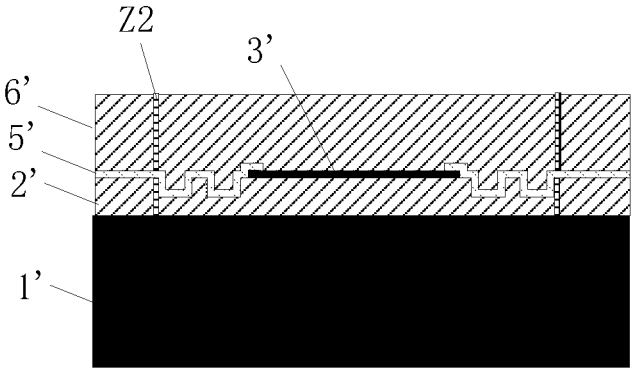
FIG. 8C shows a structural schematic diagram after forming a second etch-stop layer according to another preferred embodiment of the present invention.

In the embodiment, between the step d) and the step e), specifically comprises: firstly, forming a ring-shaped groove in edge region of the second dielectric layer 6'; and then depositing and forming a second etch-stop layer Z2 in the ring-shaped groove as shown in FIG. 8C. FIG. 8C shows a structural schematic diagram after forming the second stop layer according to another preferred embodiment of the present invention.

Figure 8D:
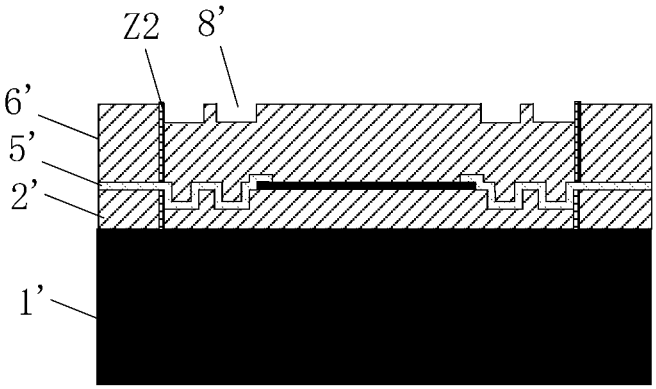
FIG. 8D shows a structural schematic diagram after forming second grooves according to another preferred embodiment of the present invention.

In the embodiment, the step f) specifically comprises: forming several second grooves 8' in the second dielectric layer 6' which is located between the second etch-stop layer Z2 and the upper polar plate 7' as shown in FIG. 8D. FIG. 8D shows a structural schematic diagram after forming the second groove according to another preferred embodiment of the present invention;

In the embodiment, the step j) specifically comprises: removing the first dielectric layer 2' located below the lower polar plate 3' through the back cavity Q', and stopping at the first etch-stop layer Z1 to form a first air gap X1'; removing the second dielectric layer 6' located below the upper polar plate 7' through the release holes V' and stopping at the second etch-stop layer Z2 to form a second air gap X2'. Finally, the structure of the capacitive silicon microphone shown in FIG. 5 is obtained.

In summary, in the capacitive silicon microphone and the fabrication method thereof provided in the present invention, the use of the first elastic member will release the structural stress of the lower polar plate, enhance the sensitivity of the lower polar plate to sound pressure, and reduce the mechanical noise of the lower polar plate. The second elastic member will effectively release the structural stress caused by the upper polar plate and the second dielectric layer, enhance the flatness of the upper polar plate and reduce the overall noise of the MEMS microphone.

Although the present invention has been described above with reference to preferred embodiments, these embodiments are only intended to conveniently explain and illustrate, but not to limit the present invention. It should be understood by persons skilled in the art that the above embodiments could be changed and modified without departing from the scope and spirit of the present invention. The scope of the present invention shall be defined by the claims.

The invention claimed is:

1. A capacitive silicon microphone comprises:

a substrate with a back cavity;

a first dielectric layer, which is formed over the substrate;

a lower polar plate, which is located over the back cavity, as a vibrating diaphragm of the capacitive silicon microphone;

a first elastic member, which has an inner edge and an outer edge, the inner edge thereof being connected with edge of the lower polar plate, and the outer edge thereof being located on the upper surface of the first dielectric layer;

a second dielectric layer, which is located on the outer edge of the first elastic member and right above the first dielectric layer;

an upper polar plate as a back electrode of the capacitive silicon microphone, which has a plurality of release holes and is formed above the lower polar plate with an air gap in between;

a second elastic member, which has an inner edge and an outer edge, the inner edge thereof being connected with edge of the upper polar plate, and the outer edge thereof being located on the upper surface of the second dielectric layer;

wherein the vertical section of the first elastic member and/or the second elastic member is concave-convex shape, and the horizontal section of the first elastic member and/or the second elastic member is concave-convex shape.

2. The capacitive silicon microphone according to claim 1, which is characterized in that, inner sidewall of the first dielectric layer has a first etch-stop layer, and/or inner side-wall of the second dielectric layer has a second etch-stop layer.

3. The capacitive silicon microphone according to claim 1, which is characterized in that, the first elastic member has at least two first elastic elements that uniformly distribute at the periphery of the lower polar plate, and the second elastic member has at least two second elastic elements that uniformly distribute at the periphery of the upper polar plate, each of the first elastic elements has an inner edge connected with the edge of the lower polar plate and an outer edge located on the upper surface of the first dielectric layer, each of the second elastic elements has an inner edge connected with the edge of the upper polar plate and an outer edge located on the upper surface of the second dielectric layer.

4. The capacitive silicon microphone according to claim 1, which is characterized in that, the first elastic member has a first elastic coefficient, and the second elastic member has a second elastic coefficient, the second elastic coefficient is higher than the first elastic coefficient.

5. The capacitive silicon microphone according to claim 4, which is characterized in that, the first elastic member and the second elastic member are regarded as a spring, and the surface stress of the upper polar plate and the lower polar plate may be calculated from the following formula:

$$TS=(\mathrm{Asp}/\mathrm{Asp-covered})\cdot(K1/\mathrm{Ssp})\cdot(\mathrm{Wsp}/K2)\cdot(\mathrm{Thsp}/Th0)\cdot T0$$

wherein TS indicates the surface stress of the lower polar plate when the first elastic member is set or the surface stress of the upper polar plate when the second elastic member is set, Asp indicates effective area of the corresponding spring, Asp-covered indicates region area of the corresponding spring, Ssp indicates the number of the coils of the corresponding spring, Wsp indicates the diameter of the corresponding spring, Thsp indicates the length of the corresponding spring, Th0 indicates the thickness of the air gap, T0 indicates the surface stress of the lower polar plate when the first elastic member is not set or the surface stress of the upper polar plate when the second elastic member is not set, K1 indicates the elastic coefficient of the corresponding spring in single turn, and K2 indicates the elastic coefficient of the corresponding spring in unit width.

6. The capacitive silicon microphone according to 1, which is characterized in that, the structure of the upper polar plate or the lower polar plate is a polycrystalline silicon film.

7. The capacitive silicon microphone according to claim 2, which is characterized in that, the structure of the upper polar plate or the lower polar plate is a polycrystalline silicon film.

8. The capacitive silicon microphone according to claim 3, which is characterized in that, the structure of the upper polar plate or the lower polar plate is a polycrystalline silicon film.

9. The capacitive silicon microphone according to claim 1, which is characterized in that, the structure of the upper polar plate or the lower polar plate is a polycrystalline silicon film.

10. The capacitive silicon microphone according to claim 4, which is characterized in that, the structure of the upper polar plate or the lower polar plate is a polycrystalline silicon film.

11. The capacitive silicon microphone according to claim 5, which is characterized in that, the structure of the upper polar plate or the lower polar plate is a polycrystalline silicon film.

* * * * *